US007096644B2

(12) United States Patent
Rimondi

(10) Patent No.: US 7,096,644 B2
(45) Date of Patent: Aug. 29, 2006

(54) FILM FOLDING AND SUPPLYING APPARATUS FOR STRETCH FILM PACKAGING MACHINES

(75) Inventor: Renato Rimondi, Bazzano (IT)

(73) Assignee: A.W.A.X. Progettazione E Ricerca S.r.l., (IT)

( * ) Notice: Subject to any disclaimer, the term of this patent is extended or adjusted under 35 U.S.C. 154(b) by 21 days.

(21) Appl. No.: 10/505,410

(22) PCT Filed: Mar. 17, 2003

(86) PCT No.: PCT/EP03/02771

§ 371 (c)(1),
(2), (4) Date: Aug. 24, 2004

(87) PCT Pub. No.: WO03/080443

PCT Pub. Date: Feb. 10, 2003

(65) Prior Publication Data

US 2005/0241273 A1 Nov. 3, 2005

(30) Foreign Application Priority Data

Mar. 27, 2002 (IT) ..... BO2002A0155

(51) Int. Cl.
*B65B 41/16* (2006.01)

(52) U.S. Cl. ..... 53/389.4; 53/556

(58) Field of Classification Search ..... 53/441, 53/442, 509, 556, 557, 389.4
See application file for complete search history.

(56) References Cited

U.S. PATENT DOCUMENTS

| | | | | |
|---|---|---|---|---|
| 4,507,904 | A * | 4/1985 | Treiber | 53/557 |
| 4,796,405 | A * | 1/1989 | Owen et al. | 53/556 |
| 4,827,694 | A * | 5/1989 | Owen et al. | 53/556 |
| 4,841,715 | A * | 6/1989 | Suga | 53/556 |
| 5,103,621 | A * | 4/1992 | Matsumoto | 53/556 |
| 5,509,253 | A * | 4/1996 | Cappi et al. | 53/556 |
| 5,603,198 | A * | 2/1997 | Rimondi et al. | 53/556 |
| 6,170,236 | B1 * | 1/2001 | Whitby et al. | 53/556 |
| 6,247,292 | B1 * | 6/2001 | Whitby et al. | 53/556 |

FOREIGN PATENT DOCUMENTS

EP 0340157 * 11/1989

* cited by examiner

*Primary Examiner*—Louis Huynh
(74) *Attorney, Agent, or Firm*—Stites & Harbison PLLC; Marvin Petry

(57) ABSTRACT

A film folding and supplying apparatus for machines for packaging products with stretchable film comprising a pleating means for folding ends of a film traveling in a direction, to modify the width of the film in such a manner that the last edges of the film on the bottom of a product to be wrapped do not laterally project from the bottom of the product. The pleating means cooperates with rolling friction of the traveling film and comprises an elongate, flat and fixed guide having longitudinal edges with projecting rows of flat, idle and rounded edges wheels; and respective lateral guides having projecting rows of flat, idle and wheels with rounded edges which fold the film.

15 Claims, 3 Drawing Sheets

FILM FOLDING AND SUPPLYING APPARATUS FOR STRETCH FILM PACKAGING MACHINES

This application is a 371 of PCT/EP03/02771 filed Mar. 27, 2003.

BACKGROUND OF THE INVENTION

The invention relates to constructive improvements in a film folding and supplying unit for the machines described in the Italian patent n. 1 266 296, property of the same applicant, to which is made wide reference. In this type of machines, the packaging film has a width which is suitable for the packaging of products which have variable dimensions inside a large range and its width is proportionate to that of the products having the greatest dimension that the machine can wrap. The width of the film is adapted to the dimensions of the product to be wrapped, with a process of pleating of the same film during the feeding phase to the wrapping phase, so that the longitudinal axis of the pleats which are oriented in the length direction of the portion of film inserted in said station and such that in the packaging of products having small dimensions, it is in any case provided for the formation of a wrapping which is enough wrapped and blocked. In this type of machines, the film is unwound from the feeding bobbin, passes through the tightening pulley which provides a longitudinal tensioned feeding and then is transmitted on a transversal and arched roller which transversally tensions the same and avoid the formation of uncontrolled pleats because the film is coming out from said roller with an ascending direction and runs longitudinally with its own center portion, on a rectilinear guide anteriorly provided with an idle roller which facilitates the entry of the film the lateral edges of which are folded under said guide by means of respective lateral guides, the whole in such a manner that the film is folded with a pressed omega transversal shape, and presents in such manner a width which is proportionate to the width of the product to be wound. Said curved transmission roller has been resulted of difficult realization so that it has been thought to substitute the same with a composite roller formed by a central roller and two long lateral rollers, having the same distance from the central roller with an angle of about 170° Another drawback found in the apparatus of the known type, is due to the great contact surface of the film with the folding guides above mentioned which were realized with polished metal or with material having a low friction coefficient. To improve the folding action performed by the guides, the same have been provided on the edges which was before operating in contact with the film, with rows of idle wheels with which the film is co-operating with rolling friction.

The lateral edges of the film which is coming out from said folding which are external to the folded portion of the said film, run upon rubber and idle rollers upon which the same are maintained in contact by a contrast superior roller, idle, but made of metal and sprung, after that the folded film arrives to a gripper-shaped distributor, made by a lower fixed portion, to which there is fixed in projecting manner said longitudinal and central guide, and by an upper portion assembled upon a structure which may oscillates upon an anterior axis which is parallel to the same distributor, and which is carrying the final folder of the machine, the one which is folding on the bottom of the product the last portion of film previously retained by the same distributor, and which is carrying the heated conveyor for the welding of the lower edges of the packaging. This structure may be raised with oscillation upon said transversal axis, in the initial phase in which the film coming from a new bobbin must be inserted in a machine. Upon this structure there is assembled said metallic and sprung roller which co-operates with said rubberized rollers. The distributor of the film realized with the known technique, is complex and scarcely reliable. An object of the invention is to improve the distributor and to provide freewheel means in the upper metallic roller contrasting the rubberized rollers, in such a manner that the film which passes through said rollers may only go forward and not backward.

In the apparatus of the described type, both folding guides of the lateral edges of the film fed by the machine, and the rubberized rollers, are pre-arranged to be automatically adjustable in the reciprocal distance by means of self-centering regulation mechanism, controlled by an electric step motor controlled by the computer of the machine which by means of the optical barriers detects the dimensions of the products to be packaged, to automatically adjust to these the width of the packaging film.

SUMMARY OF THE INVENTION

The present invention is directed to a packaging machines which is more economic and is able to give the same quality of packaging as the prior mentioned machines, using rubberized contrast rollers having a sufficient length and with static positioning and pre-arranging the guides for the folding of the edges of the film fed by the machine, with a manual regulation of the reciprocal distance. The products that the packaging machine may process are dimensionally divided in two groups, group of the medium-small products and a group of large products and for each group of products, film bobbins of different width are used, naturally more wide for the group of wide products, so if the machine had to pass from the operation of a group of products to another group of products, the bobbin of the film is changed and the pleating means of the same film are adjusted in a suitable manner. When the machine is pre-arranged for the processing of a group of products, the width of the folded film is chosen with regard to the width of the products having the smaller dimensions of that group and the width of the pleated film may be adjusted or remain constant, both for working of the small products and for the large ones of the same group.

BRIEF DESCRIPTION OF THE DRAWINGS

These and other features of the improvements which is referred to and the is advantages deriving therefrom, will appear better evident from the following description of a preferred embodiment of the same, made by way of non-limiting example, with reference to the figures of the attached sheets of drawings, in which.

DETAILED DESCRIPTION

Figure 1:
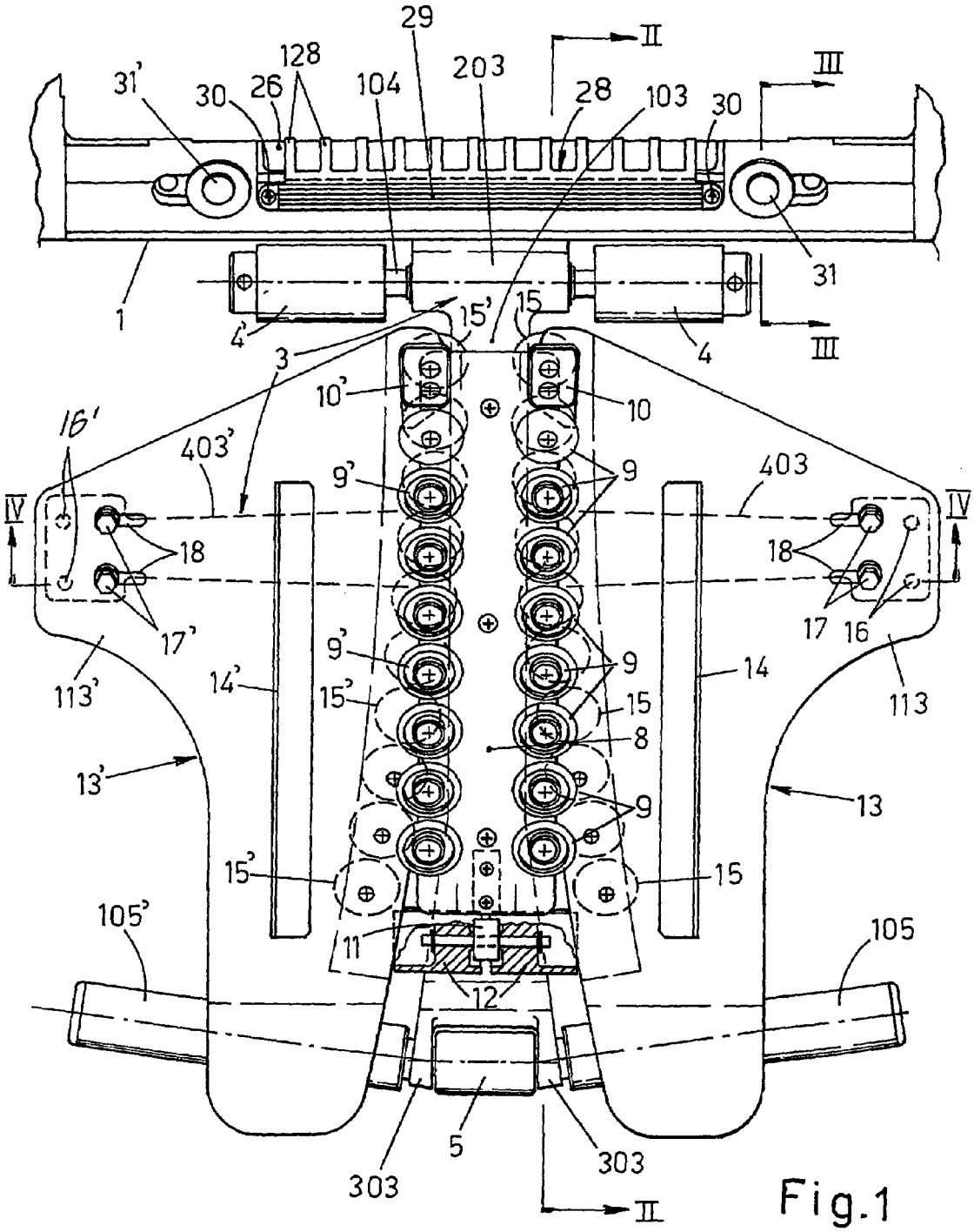
FIG. 1 is a plan view from the top of the improved apparatus which is referred to, without the overhanging structure which carries the sprung roller opposed to the rubberised rollers and the upper comb of the final distributor.
Figures 2, 3:
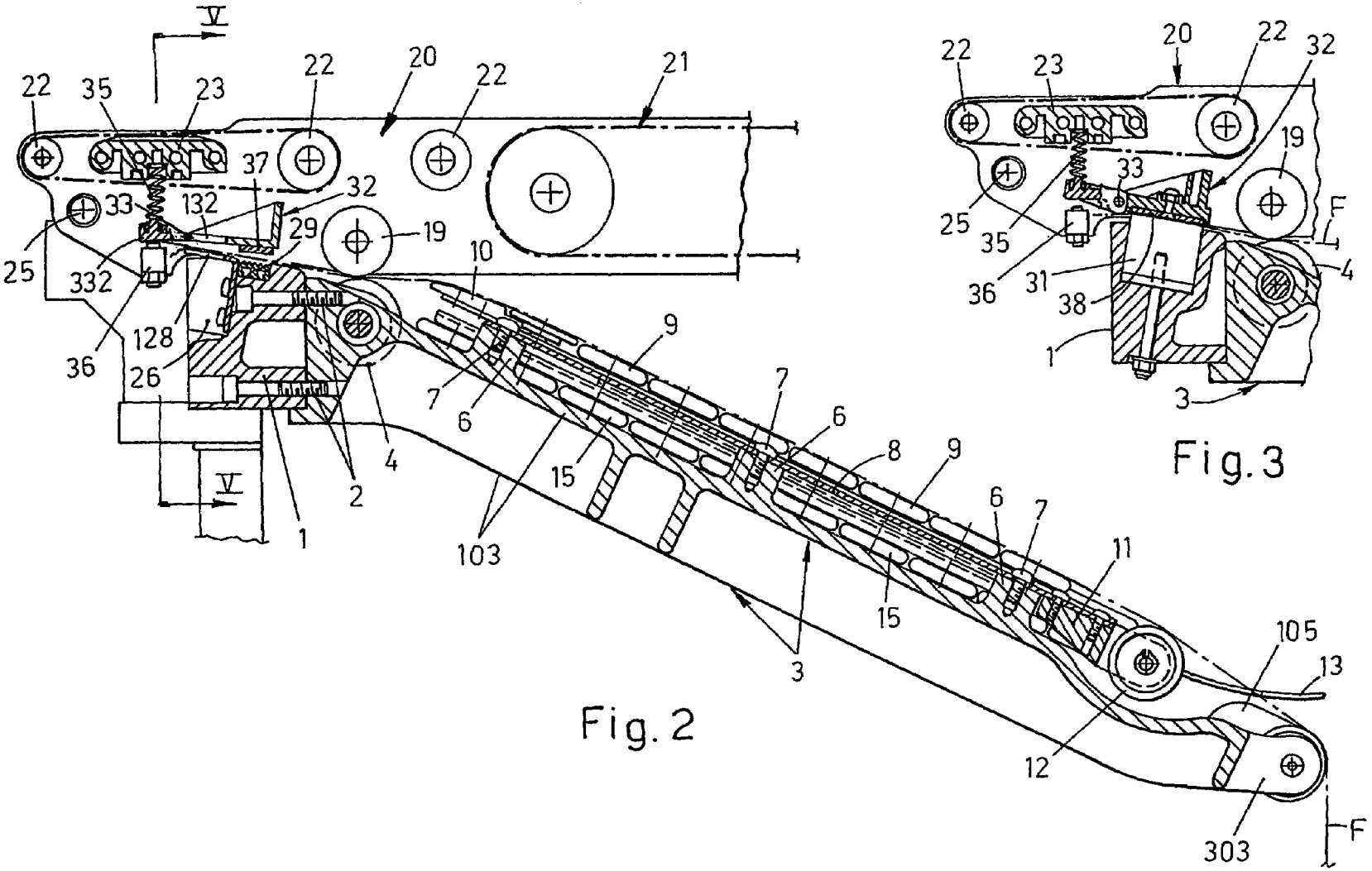
FIG. 2 shows other details of the apparatus longitudinally sectioned along the line II—II of FIG. 1.
FIG. 3 shows the complete final distributor of the film as from FIG. 2, in closing position and sectioned along the line III—III of FIG. 1.

The terms _"front_" and _"rear_" are here considered used within this disclosure with reference to the running direction of the film. Therefore, the term _"front_" is that portion which the film first encounters as it advances. In FIGS. 1 and 2, numeral reference 1 indicates the horizontal traverse member fixed with its ends to the sides of the frame of the machine, transverse to the path of the film F and which is carrying the lower jaw of the distributor of the same film, as will be discussed in further detail below. In the centre line of the front of the traverse member 1, there is projecting fixed, by means of screws 2, the enlarged end 203 of the longitudinal member 103 of a ribbed structure 3 which has in plant a cross shape which is longitudinally downwardly inclined, upon said end 203 being rotatably assembled the intermediate portion of a shaft 104 which is parallel to the traverse member 1 and on the ends of which there are keyed the rubberized and equal rollers 4, 4', which support the lateral edges of the film which is coming out from the folding means further mentioned. The rollers 4, 4' have a length which is superior to these provided in the known art and their reciprocal distance remains the same upon variations of the products to be packaged. The most lower end of the longitudinal member 103 of the structure 3 ends with a fork conformation 303, which in its interior supports projecting and rotatably a roller 5 and which with its sides, which are diverging and inclined of about 8°–10° supports rotatably longer and equal rollers 105, 105', that with the roller 5 make a convex transmission which substitutes the arcuate roller in the prior art, upon which is transmitted the film unwound from the bobbin and coming from the tensioning pulley, to be transversally stretched, to be maintained centered on the following folding means and to be pre-arranged in the best manner for the co-operation with said means.

The longitudinal member 103 of the structure 3, carries superiorly distributed projections 6 upon which there is fixed with screws 7 the longitudinal and median portion of a plate 8 with rectangular plan shape, having suitable dimensions, the longitudinal edges of which are slightly upwardly inclined and freely support rotatably rows of wheels 9, 9' with a rounded shape, which are suitable projecting from said support edges of the plate 8, to substitute these in the guiding of the film during the folding phase. At the end of each rows of wheels 9, 9', and in conditions of substantial tangency with the external edge of these, the plate 8 supports plates 10, 10', with edges which are suitably rounded and with a low friction coefficient with the film. In the centre-line of the anterior end of the plate 8 there is inferiorly fixed, and with a longitudinal arrangement, a support 11 which is anteriorly projecting from the same plate to rotatably support a side by side couple of rollers 12 having the same dimensions, the general width of which is substantially equal to the width which exists between the external sides of the rows of wheels 9, 9'. The film which leaves by the convex transmission means made by rollers 5, 105 105', is resting with its median and longitudinal band on the sliding structure made by the rollers 12 and by the wheels 9, 9' and the same film is folded under said rows of wheels, by the convex sides of guides 13, 13', reinforced by upper and longitudinal inserts 14, 14' and provided with intermediate appendices 113, 113' for the outside extension, with which said guides are fixed at the ends of the transversal arms 403, 403' of the cross structure 3 above mentioned (see further). The convex edges of the guides 13, 13' carry a slightly downwardly bent portion, under which there are fixed the one following the rows of wheels 15, 15' of the same kind of those with numeral reference 9, 9', which with the exception of the first ones are projecting from said edges for the cooperation with rolling friction with the lateral edges of the film F which for the co-operation with said means, is folded under the guiding median complex formed by the portions 8, 9, 9', as it appears from FIG. 4, in such a manner to take an omega transversal shape. From FIG. 4 it is clear how thanks to the slight inclination of the axles of the rows of wheels 9, 9' and 15, 15', the film touches only a portion of the circumference of the said wheels and it is distant from the superior and inferior faces of the same wheels. From FIGS. 1, 2 and 4 it is noted that the arms 403, 403' of the structure 3 are also ribbed with a U overturned shape and terminate with flat and enlarged appendices upon which there are provided at different distances from the longitudinal member 103 of the same structure 3, couples of threaded holes 16, 16' in which there can be fixed corresponding couples of screws 17, 17' which are fixing in working position the guides 13, 13' with the relative rows of wheels 15, 15'. The screws 17, 17' pass through corresponding slots 18, 18' obtained on the guides 13, 13', with a perpendicular orientation to the travelling direction of the film F. In the FIGS. 1 and 4, the screws 17, 17' are positioned on the more internal holes 16, 16' and are abutting against the external ends of the slots 18, 18', in such a manner that the guides with the rows of wheels 15, 15' are in the position of maximum folding of the film under the central guide with the rows of wheels 9, 9' If required, the screws 17, 17' may be positioned on the more external couple of holes 16, 16', and the slots 18, 18' may be carried against with said screws, with their internal ends, in such a manner that the rows of wheels 15, 15' result to be substantially positioned outside of the rows of wheels 9, 9'. It is clear that depending on the film used and on the product to be packaged, the guides with the rows of wheels 15, 15' may be placed in any intermediate position comprised between the extreme positions above mentioned.

Figure 4:
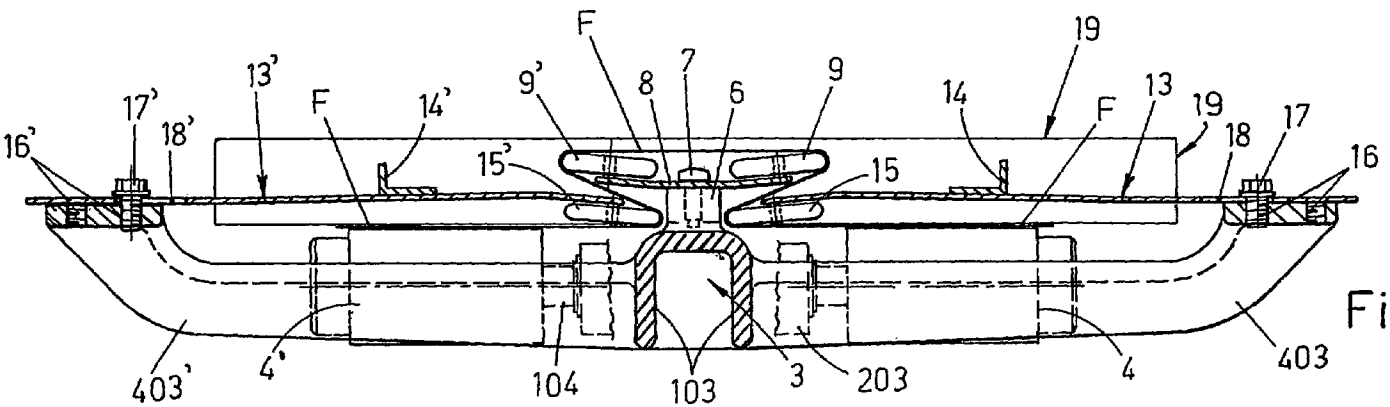
FIG. 4 shows other details of the apparatus transversally sectioned along the line IV—IV of FIG. 1.

From FIGS. 1, 2 and 4 it is noted that the film which is coming out from the described folding means, is transversally surmounted by the steel sprung roller 19 which pushes the edges of the same film on rubberised rollers 4, 4' and as mentioned in the introduction of the present description, it is now assembled upon its support axle, with the interposition of free-snap wheels, in such a manner that the film may only move forward between said rollers, and not recede. The sprung roller 19 is assembled on the sides of the know type structure 20 which carries the motorised conveyor 21 for the displacement of the packaged products and for the thermo-welding of the lower edges of the packaging film and that in co-planarity conditions with the upper portion of the said conveyor, supports motorised rollers 22 which are parallel between them and to the said roller 19, between which there is co-planarly arranged the fixed runner 23 provided with a recess 123 downwardly open, which houses the toothed saw 24 (FIG. 5) against which is pushed the packaging film by means of a parallel and grooved lifter, not shown. Structure 20 is anteriorly fulcrumed to the frame of the machine, with lateral hinges 25, in such a manner that can be raised together with the roller 19, to facilitate the introduction of the film between the folding means each time that the bobbin of the packaging film must be replaced and the same film must be correctly transmitted between the same folding means described.

Figure 5:
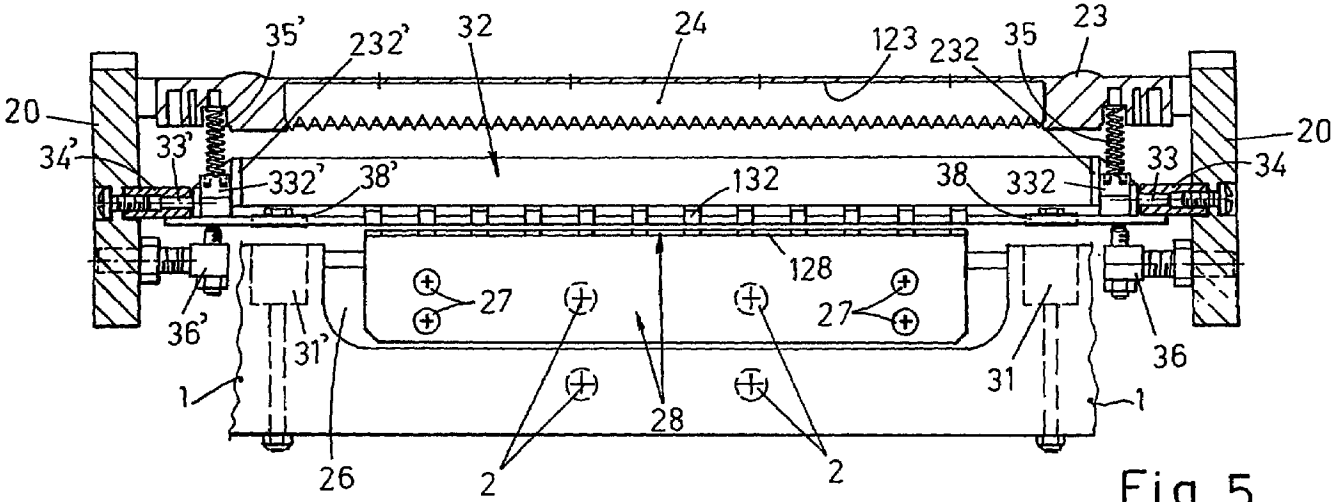
FIG. 5 shows further details of the distributor sectioned along the line V—V of FIG. 2.

From FIGS. 1, 2 and 5 it is noted that the traverse member 1 is placed with its upper wall at a level which is slightly superior to that of the film which is passing between the rollers 19, 4, 4', has the rounded edges and the same traverse 1 is anteriorly and superiorly open with a recess 26 which has substantially the same length of the distance which passes between the external sides of the rollers 4, 4' and in which there is fixed with the screws 27, a jaw 28 having the shape of a small square member, the upper wall 128 of which is co-planar to the one of the traverse member 1 and is comb-shape, with the teeth oriented and opened in the travel direction of the film. Upstream of the comb 128, the upper portion of the traverse member 1 carries a recess which is parallel to the same comb, in which there is housed, not projecting a rubberized grooved insert 29 which is blocked in situ for example by means of end screws 30. Outside of the unit 28, 29, at a short distance from its ends, on the traverse member 1 are superiorly provided recesses which house electromagnets 31, 31' (see also FIG. 3). Over of the traverse member 1, at a short distance and parallel to this one there is arranged with its flat and toothed portion which forms a comb 132 complementary to the lower comb 128, a jaw 32 L-shaped to resist the bending-torsion stresses, which is upwardly raised with its anterior ribbed portion, which is provided at least on the ends with transversal ribs 232, 232', and which is carrying laterally pins 33, 33', which are parallel to their longitudinal axis and corresponding with the point of the teeth of the comb 132, which with the same jaw which is referred to is fulcrumed at corresponding supports 34, 34', fixed to the sides of the structure 20. The jaw 32 carries at its end, onward extension appendices 332, 332', pre-arranged in such a manner that on the same may operate the end of springs for downwardly urging, which maintain said appendices attested against lower and adjustable retainers 36, 36' fixed to the near sides of the structure 20, in such a manner that the upper comb 132 results opportunely spaced from the lower comb 128 and that the film may freely run through the so made distributor. On the lower wall of the swinging jaw 32, upstream of the comb 132, there is fixed in relief a strip 37 of rubber and with longitudinal lines. When the distributor is opened as from FIG. 2, the strip 37 is raised and opportunely spaced from the lower one indicated with reference numeral 29, and form the ferromagnetic disks 38, 38' fixed to the inferior side of the same jaw 32 and centered with electromagnets 31, 31', are opportunely spaced from this latter components de-energized. When, on the contrary, the electromagnets 31, 31' are energized, as from FIG. 3, these attract the above mentioned disks 38, 38' and cause downwardly oscillation of the portion of the upper jaw 32 which is provided of the rubber strip 37 which blocks the film on the lower rubber strip 29, in contrast with the action of springs 35, 35', which are proportionally compressed, in such a manner to re-open, at the right time, the distributor as the energization of the said electromagnets 31, 31' ceases. Suitable means may be provided for the partializing of the energization of the electromagnets, 31, 31', in order to allow that the film results to be always transversally seized with pliers in the distributor, but in a position in which it can suitably run in longitudinal direction. This condition may be, for example especially useful in the phase in which the packaging film is transversally pre-stretched by some of the lateral grippers of the packaging machine.

The invention claimed is:

1. A film folding and supplying apparatus for machines for packaging products with stretchable film, said apparatus comprising:

pleating means placed between a feeding bobbin of film and a wrapping station, for folding a portion of film with the folds oriented in a traveling direction of the film, to thereby modify the width of the film in such a manner that the edges of the film on the bottom of the product, during a normal working cycle of the packaging machine, do not laterally project from the bottom of the product, said pleating means comprising:

an elongate, flat and fixed guide having longitudinal edges with projecting rows of flat, idle wheels with rounded edges, which provide edges of the guide to co-operate with the film with rolling friction, and respective lateral guides to said rows of wheels of said fixed guide, having longitudinal internal edges with projecting, respective rows of flat, idle wheels with rounded edges, whereby wheels of the fixed guide cooperate with wheels of the lateral guides to partially fold the film.

2. The film folding and supplying apparatus of claim 1, wherein the pleating means is further for forming a substantially omega transversal section in the film.

3. The film folding and supplying apparatus of claim 1, wherein the pleating means is adjustable to accommodate films of at least two different widths and to pleat the film with a width proportionate to one of the two different ranges of medium-small products and large products which can be packaged by a single machine.

4. The film folding and supplying apparatus of claim 1, further comprising means for the adjusting of the pleating means so that the pleating means can pleat the film with a width which is proportionate to a smaller width of a product to be packaged of the two different ranges of medium-small products and large products packageable by a single machine.

5. The film folding and supplying apparatus of claim 1, wherein the longitudinal edges of the fixed guide are slightly upwardly bent, in such a manner that the rows of wheels of the fixed guide rotatably placed on the edges form an upwardly concave sliding surface, so that a medial portion of the film in a folding phase does not touch the upper face of said wheels of the fixed guide.

6. The film folding and supplying apparatus of claim 1, wherein the longitudinal internal edges of the lateral guides, are slightly downwardly bent, so that the rows of wheels of the lateral guides rotatably assembled upon said edges form a downwardly convex sliding surface, so that the edges of the folded film do no touch the lower face of said wheels of the lateral guides.

7. The film folding and supplying apparatus of claim 1, wherein the fixed guide is provided in a terminal and posterior portion of its lateral edges, with plates having rounded-edges made with suitable low-friction coefficient material, which with an external side are in a substantial tangency condition with a peripheral and active portion of a last folding wheels carried by the same lateral edges of the fixed guide to permit the plates act together to fold and guide the film in a correct manner during a folding phase.

8. The film folding and supplying apparatus of claim 1, wherein the fixed guide with the rows of wheels is fixed with its center line upon projections carried by a longitudinal member of an underlying ribbed and a cross-support, said longitudinal member being fixed with one end, and in projecting manner, to a traverse member which supports a distributor of the film and being downwardly inclined with the other end which is projecting for a portion from an anterior end of said fixed guide, under which there is fixed, on a central line, a support which is rotatably supporting in front of said fixed guide and transverse to this, a double roller having the same width of the sliding track made by the wheels of said fixed guide and upon which the film slides before reaching on said wheels.

9. The film folding and supplying apparatus of claim 8, wherein the anterior end of said longitudinal member of the support which supports the fixed guide, ends with a fork conformation to support rotatably free, a central roller and consecutively to this, a couple of lateral and equal rollers angularly spaced from the central roller of about 8–10°, in such a manner to form a convex shape which is transferred to the film before reaching the pleating means, to maintain the film stretched in a transverse direction.

10. The film folding and supplying apparatus of claim 8, wherein the end of the longitudinal member of the cross-support, which is fixed to the traverse member for supporting a film distributor, is enlarged and rotatably supports an intermediate portion of a shaft which is horizontal and transverse to the path of the film, upon which there are fixed rubber rollers, whereby upon said fixed rubber rollers, the lateral edges of the film slide as film which is coming out from the pleating means, the film being pushed against said rollers by means of an overhanging parallel roller which via utilization of freewheels, is freely rotatable only in the running direction of the film and not in an opposite direction.

11. The film folding and supplying apparatus of claim 8, wherein the traverse member which supports, in a projecting manner, the cross-support with the pleating means, has rounded edges and is disposed at a level that upon said cross-support, the folded film can run, said traverse member being provided on the posterior front for the exit of the film and on the upper wall, with a recess in which there is fixed a jaw with an upper portion comb, with teeth opened and oriented accordingly to the running direction of the folded film and upstream of said jaw and parallel to the jaw, said traverse member being provided with a recess having a length which is the same as that of said jaw, which houses in a condition of non-projection, a rubber insert with longitudinal grooves and being provided so that the same traverse member is provided at the level of the ends of said jaw, with recesses housing electromagnets for the closure of a film distributor of the film inferiorly formed.

12. The film folding and supplying apparatus of claim 11, further comprising:

a complementary comb formed in a lower portion of a traverse with an L lateral shape, superior to the upper portion comb, said complementary comb suitably ribbed at least at the ends which are fulcrumed on an axle which is parallel to the longitudinal axis of said complementary comb and which passes by a point of the teeth of the same comb, the traverse member being provided at the ends with appendices which transversally extend in the running direction of the film and beyond the point of the teeth of its comb, upon which appendices there operate elastic means which push said appendices against lower and adjustable retainers, in such a manner to maintain the comb of the distributor raised from the complementary comb and to maintain a strip of rubber upwardly fixed on the lower face of the same upper comb, raised and distant from the opposed rubber insert of the lower jaw of the same distributor, and outside of the comb of the jaw, ferromagnetic disks inferiorly disposed and opposed to the electromagnets which, when are energized, attract said disks and the comb, in order to stop the film between the strips of rubber of the two combs of the distributor.

13. The film folding and supplying apparatus of claim 12, further comprising energization means for the electromagnets to supply a variable energization according to a pre-established program which provides a loosening of a clamping of the film in a working phases of a packaging machine.

14. The film folding and supplying apparatus of claim 1, wherein the lateral guides are reinforced by suitably ribs and carry intermediate appendices, said lateral guides having slots transverse to the path of the film and through which screws are disposed for fixing said lateral guides on flat ends of arms of a cross-support, in such a manner that it is possible to adjust the distance between the lateral guides with a variation which is equal to the length of said slots.

15. The film folding and supplying apparatus of claim 14, wherein the flat ends of the arms of the cross-support are provided with a pair of threaded holes having a different distance from a longitudinal member of the said cross-support and in said holes may be screwed the fixing screws for the lateral guides, in such a manner that said guides may be adjusted in a reciprocal distance, in addition to pitch resulting from the length of said slots, also with the pitch given by the distance between the pair of threaded holes.

* * * * *